United States Patent [19]

De Rouen

[11] Patent Number: 4,562,325

[45] Date of Patent: Dec. 31, 1985

[54] DECORATABLE WALL SWITCH ACTUATOR

[76] Inventor: Keith J. De Rouen, 100 Amy St., New Iberia, La. 70560

[21] Appl. No.: 561,543

[22] Filed: Dec. 14, 1983

[51] Int. Cl.[4] ..... H01H 17/30

[52] U.S. Cl. ..... 200/331

[58] Field of Search ..... 200/331, 339, 333, 330, 200/336, 329; 174/55, 56, 66; D13/32

[56] References Cited

U.S. PATENT DOCUMENTS

| | | | |
|---|---|---|---|
| 2,252,829 | 8/1941 | Bell | 200/330 |
| 2,257,033 | 9/1941 | Bissell | 200/331 |
| 2,461,614 | 2/1949 | Seaman | 200/331 |
| 2,466,820 | 4/1949 | Oberschmidt | 200/331 |
| 2,574,933 | 11/1951 | Ogren | 200/330 |
| 2,639,356 | 5/1953 | Savage | 200/336 |
| 2,961,501 | 11/1960 | Piteo, Jr. | 200/330 |
| 3,369,100 | 2/1968 | Kussy et al. | 200/330 |

*Primary Examiner*—Stephen Marcus
*Assistant Examiner*—Renee S. Kidorf
*Attorney, Agent, or Firm*—Keaty & Keaty

[57] ABSTRACT

A wall switch actuator is provided in the form of a decorative plaque having an attractive external design. The actuator is pivoted around a single pivot point adapted to being substituted for the standard upper screw on the standard two-screw wall switch plate. A unique curved cam section is provided within the plaque at a known distance from and angled to the pivoting screw for actuating a standard wall switch from a first position to a second position as the plaque is rotated about the pivot screw from a first rotated position to a second rotated position. Pull cords are provided at two extremeties of the plaque permitting the plaque to be rotated from the first rotated position to the second rotated position by pulling on the selected pull cord thus actuating the light switch. A preferred embodiment of the invention uses child's figures for decorating the plaques and provides pull cords permitting a small child to safely turn on or turn off a light in a child's room.

2 Claims, 3 Drawing Figures

DECORATABLE WALL SWITCH ACTUATOR

BACKGROUND OF THE INVENTION

A light switch pull or mechanism for converting an existing standard light switch to enable it to be actuated either by children or by pulling on one or more cords is known to the art. However, preceeding versions have all involved certain disadvantages which make them unsuitable as widely produced, easily installed adapters for existing light switches.

The prior art in this area can be essentially divided into two classes. The first involves devices which are best installed within the mechanism of the switch itself. Typical of these is U.S. Pat. No. 2,461,614, Seaman, showing an external pivot arm being actuated by two pull cords, which in turn actuates a switch. Variants on this mechanism can be seen in U.S. Pat. No. 4,221,946, Halstrum, and U.S. Pat. No. 2,466,820, Oberschmidt. In each case a metal arm or similar substantially strong arm mounted to a side pivot point is actuated between a first and a second angle. A small aperture within the metal arm firmly encloses the normal switch handle extension of a switch. Each of these units involves at least two subassemblies; a pivot joint is required between the two subassemblies; relatively tight manufacturing tolerances are required, and the structure must be fastened at at least two locations, within the existing switch plate.

The second line of development involves sliding mechanisms which, in essence, replace the existing switch plate upon a wall switch. Such units include U.S. Pat. No. 2,760.035, Friesen, showing a rather elaborate casing enclosing a moving actuating mechanism, positioned by two pull cords. Similar vertical sliding mechanisms are shown in U.S. Pat. No. 3,839,615, Bradford, showing an encased sliding vertical actuating mechanism. U.S. Pat. No. 2,582,379, Goldberg, shows an alternate form of a covering slide plate. U.S. Pat. No. 3,825,710, Roberts et al, shows a third version of the vertical slide plate in which a figure performs an animated movement.

Each of these lines of invention has, in practice, significant disadvantages which it is desirable to overcome, especially for a child's use. The pivoting switch mechanisms all involve relatively delicate structure which can be best be mounted within a switch box or within a switch mechanism itself. They in general are mechanisms too complicated to permit easy installation in the home by unskilled personnel; often they require dangerous disassembly of electrical switches or they are simply too flimsy in practice to resist the normal wear and tear imposed upon the mechanism by a child.

The sliding mechanisms while appearing more rugged have the disadvantage that they are suspectable to breakage because of a lack of giving or compliance if the mechanism is twisted in any direction other than a vertical slide. It is obvious that the public, especially small children to whom such a switch would be most attractive, cannot be depended upon to exactly follow a preprogramed sequence of actuation. The result may well be a broken switch.

In either case none of the inventions shown provide an easily installed, rugged, and useful switch actuator for electrical switches which has the addition property that it allows ready decoration to provide a unit attractive to small children.

SUMMARY OF THE INVENTION

This invention provides a simple, singularly useful, easily decorated adaptor for an electric switch which permits ready operation by small children and which can be readily installed in the home, without requiring dangerous disassembly of a light switch and without requiring knowledge of electricity or significant mechanical skill.

In its simplest form, the invention comprises a decoratable plaque which may be cut in any of a number of attractive shapes or forms and which may be painted so as to resemble any of a number of attractive characters, scenes, or images, all essentially at the desire of the manufacturer.

The plaque is provided with a single pivot point permitting it to be rotated between two extreme rotating positions. The pivot point is specifically adapted so that it may be installed coaxial to the existing screw hole within a standard light switch. A unique cam aperture is provided in the body of the pivoting plaque; this aperture functions as a cam for actuating the existing handle of the light switch from a first to a second position corresponding to the two extreme rotational positions of the plaque.

This cam effect provides the invention with the capability of being used on a relatively wide variety of light switches, by making the plaque universally usable with a relatively wide tolerance for sizes and shapes of light switch handles. This feature is not present on certain prior art items which are specifically designed to a particular light switch shape, size and cross-sectional aspect ratio.

The plaque, being decorative, will readily permit location of two points essentially at opposing horizontally extreme positions of the plaque as it is mounted on the wall switch; these points are selected for attaching two pull cords for rotating the plaque between two rotational extreme positions. Thus a child, by pulling on the pull cords, can actuate the light switch through the cam, by the pivoting action of the plaque from a first position to a second position, causing the light to go on or off as desired.

It it thus an object of this invention to provide a light switch adapter which can permit a child to operate a light switch by pulling on a provided pull cord.

It is a further object of this invention to provide a light switch adapter which is capable of being made in a wide variety of decorative or attractive shapes and configurations.

It is a further object of this invention to provide a light switch adapter which has no loose parts. Further, the adapter will have no removable or breakable parts which can be separated from the main body of the adapter and which may provide injury to the child.

It is a further object of this invention to provide a light switch adapter which is capable of being installed on essentially all light switches that are of the standard design found for use in the home. The light switch adapter is essentially independent of the specific exact physical size and shape of the light switch and is usable so long as the light switch complies with current NEMA standards for in-home light switches.

It is a further object of this invention to provide a light switch adapter suitable for use in a child's room which can be installed by a parent having no knowledge of electricity, mechanics, or the like; which requires few simple hand tools for its installation; and which, most importantly, requires neither access to the internal working of the light switch nor removal of the protective plate which protects the electrically powered portions of the light switch from inadvertant access.

These and other objects of the invention are more readily discerned from the detailed description of the preferred embodiment which follows:

DETAILED DESCRIPTION OF THE DRAWINGS

DETAILED DESCRIPTION OF THE PREFERRED EMBODIMENT

Figure 1:
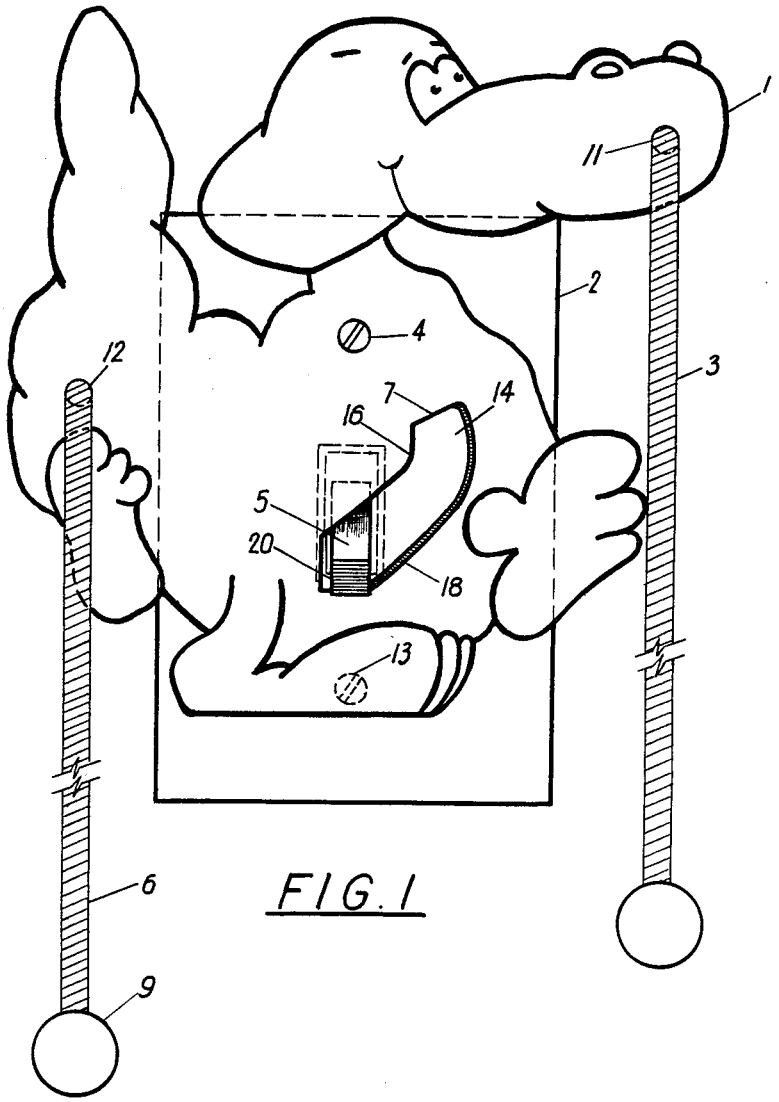
FIG. 1 is a front view of the invention as installed upon a standard wall switch.
Figure 2:
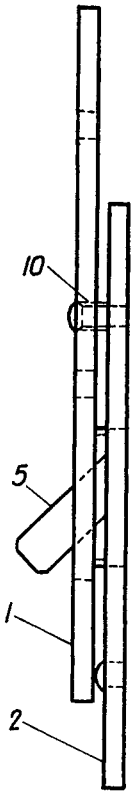
FIG. 2 is a side vertical sectional view of the invention as pivoted upon a standard wall switch.
Figure 3:
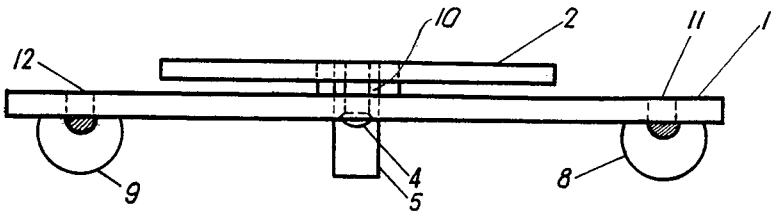
FIG. 3 is an inverted sectional top view of the invention.

Referring to FIG. 1, the invention as shown is a decoratable plaque 1 installed upon a wall switch plate 2 of standard design. As is well known, such wall switch plates 2 are installed over electrical wall switches, not shown, to conceal the dangerous, electrified portions of the wall switch from contact by the user. The wall switch plate 2 masks the entire wall switch save for an exposed switch handle 5 which, as is well known, is used to actuate the wall switch by moving the switch handle between an upper and a lower switching position.

As is well known, a wall switch plate 2 is designed to a standard so as to interface with any of a number of standard wall switches. Thus it is found that all wall switch plates 2 will contain a wall switch plate upper screw 4 as shown in FIG. 1, and a wall switch plate lower screw 13 shown in FIG. 1 masked behind plaque 1. Both the upper screw 4 and the lower screw 13 are a standard counter sunk screw or flathead screw of a type well known to the art. Further, it is found that the spacing between the upper screw 4 and the lower screw 13 is a constant throughout all switches and wall switch plates 2 in common use in American households.

As shown in FIG. 1, plaque 1 is provided about wall switch plate upper screw 4. This pivoting is aided by a pivot bearing 10. Pivot bearing 10 also provides a stop for upper screw 4 to prevent screw 4 from becoming undone. In practice pivot bearing 10 depends upon the material from which plaque 1 is created. Pivot 10 may be an installed bushing of metal or plastic.

At two positions upon plaque 1 representing opposite extreme horizontally acting lever arms with respect to upper screw 4 are found respectively, first pull cord 3 affixed to plaque 1 at first pull cord plaque attachment 11 and second pull cord 6 affixed to plaque 1 at second cord plaque attachment 12. As stated, first attachment 11 is located on plaque 1 so as to provide a horizontal lever arm about upper screw 4. Attachment 12 is positioned so as as opposing essentially equivalent horizontal lever arm about upper screw 4.

First pull cord 3 is suspended by gravity downwards from first plaque attachment 11 and terminates optionally in a first pull knob 8 which may be either a decorative knob, a plain knob, or a knot tied in first pull cord 3 so as to provide in any event a better grip upon first pull cord 3. Likewise, second pull cord 11 is suspended by gravity downwards from second attachment point 12 and terminates in a second pull knob 9 which is of a like type to first pull knob 8.

Within plaque 1 is found cam aperture 7 through which extends switch handle 5 which as stated above actuates the electric wall switch by being moved from an upper to a lower extreme position. Cam aperture 7 is seen to comprise an upper switch cam gap 14 which is a substantially wide, straight extending edge of cam aperture 7 extending for a distance somewhat greater than the maximum expected width of the anticipated switch handles 5 and counter and standard switches in use within the United States. Extending from upper cam gap 14 in a generally clockwise direction from each of the two ends of upper cam gap 14 are found cam down switch curve 16 along an inner curve generally centered about upper screw 4 in a manner to be more hereinafter described and cam upswitch curve 18 which generally tends parallel to cam downswitch curve 16 but is of a greater radius by the width of upper switch cam gap 14. Switch curve 16 and switch curve 18 terminate in lower switch cam gap 20 which is of the same width as upper switch cam gap 14.

The curves of downswitch curve 16 and upswitch curve 18 differ and are of a particular importance to the proper functioning of the overall invention. Curve 16 is throughout its length an essentially circular offset cam curve, having a center of radius offset from upper screw 4 such that as plaque 1 is pivoted about upper screw 4 switch handle 5 contacts curve 16 in a manner such that a radius from screw 4 to the point of contact of curve 16 and switch handle 5 varies so that when said point of contact is adjacent to upper cam gap 14 the radius is equivalent to the distance between screw 4 and handle 5 when handle 5 is in an upward switching position, and when the point of contact between handle 5 and curve 16 is near lower cam gap 20 the radius between screw 4 and this point of contact is equal to the distance between handle 5 and screw 4 when handle 5 is in a downward switching extreme position. In addition, at the upper end of curve 16 adjacent to cam gap 14 curve 16 is cut such that there is no contact between handle 5 and curve 16 for a distance and thereby no downward tending forces on handle 5 for contact with curve 16.

Curve 18 is differentially cut for a space adjacent to lower cam gap 20 curve 18 is essentially horizontally flat so as not to contact handle 5 for a varying sizes of handle 5 when handle 5 is in the downward switching position and when lower cam gap 20 is adjacent to handle 5. Beyond this essentially flat first section curve 18 assumes a second section as a circular arc parallel to switch curve 16, extending as a circular arc up to the point of contact enclosure with upper switch cam gap 14.

In operation decorative plaque 1 is used to manipulate switch handle 5 from an upward switching position to a lower extreme switching position thus actuating the electric switch behind wall switch plate 2 in the following manner. An operator, such as a child, will find that one of the first pull knob 8 or the second pull knob 9 is in a position lower than its other correspondence pull knob. For the version shown in FIG. 1, it will be seen that pull knob 9 is in a lower position when switch handle 5 is in a downward switch position. The operator grasps the pull cord 3 or the pull cord switch, usually by grasping the corresponding pull knob 8 or pull knob 9 whichever is higher and pulls downward. The force transmitted from the pull through the cord 3 and the attachment 11 to the plaque 1 acts upon the horizontal lever arm about the upper screw 4 and the pivot bearing 10 pivoting the plaque 1. When the knob 8 is pulled or the cord 3 is pulled, it is seen that the attachment point 11 rotates about the screw 4 in an essentially downward direction rotating the cam aperture 7 in a clockwise direction. No contact is made for a distance by any portion of the cam aperture 7 till the essentially flat first section of switch curve 18 has passed. At this point, switch curve 18 touches and contacts switch handle 5 as switch curve 18 contacting second section is essentially a circular arc. A smooth upward force is imparted to switch handle 5 moving switch handle 5 from a downward switching position to the upward switching extreme position as the cord 3 is pulled downward. This in turn actuates the switch to a second position. It is to be noted that the combination of the flat first section of curve 18 creates a sufficient motion that curve 16 during this process is moved away from a point of contact with the switch handle 5 and exerts no force upon it. The tolerance created by the extent of the flat first section of curve 18 determines the maximum size tolerances in the cross-section of switch handle 5 as would be obvious from an inspection and thus permits the plaque 1 to be used on a variety of switches having varying sized switch handle 5 within general limits.

It will then be found that switch handle 5 is in an upward extreme switching position and that plaque 1 has rotated so that knob 8 is lower than knob 9. The operator may then pull upon knob 9 or pull cord 6 exerting an opposing force downward at attaching point 12 and thus through horizontal lever arm between attaching point 12 and upper screw 4 and pivot bearing 10 such as to rotate plaque 1 in a counter clockwise direction. Again, as stated above, for a distance along curve 16 adjacent to upper cam gap 14, there is no contact with switch handle 5 thus curve 18 rotating counter clockwise curves away from and moves out of contact with switch handle 5. At this point, the upper edge of switch handle 5 contacts curve 16. Curve 16 being a generally circular arc smoothly exerts a downward camming force upon switch handle 5 returning it to a downward switching position as cord 6 is pulled downward. Thus returning the switch and the decorative plaque to the position shown in FIG. 1.

It is to be noted that there are two provided pull cords as the decorative wall plaque is designed primarily for use by children who will be well below the level of the switch. It is thus desirable to avoid any need for a pushing or upward force to actuate the switch. The combination of the two provided pull cords together with the knobs 9 and 8 for aiding small hands to grasp the pull cord 6 or the pull cord 3 and the installation of the pull cords at two attachment points 11 or 12 represent opposite actuating lever arms about pivot point 10 are all designed to permit the switch actuation mechanism to always be workable solely by means of a pull. Further, the particular construction of the plaque and the length of the selective cord 6 and cord 3 are such that either knob 8 or knob 9 will be perceptively lower than its opposite knob when switch handle 5 is in either an upper or a lower extreme switching position thus clearly indicating to a child the cord which must be pulled to reverse the condition of the switch. A child will readily learn that the higher cord must be pulled to change the switch.

It is to be noted that the strength of the cords may be designed with respect to the known strength of the plaque 1 and the pivot 10 about screw 4 such that an excessive pull will break an easily replaceable cord without breaking the plaque 1 or exerting an excessive force upon the switch handle 5. It is further to be noted that the design of the cam gap 7 and specifically the upper switch cam gap 14 and the lower switch cam gap 20 are such that at the extreme switching positions of switch handle 5 cam aperture 7 contacts switch handle 5 along its side and thus an excessive upward or downward force is not exerted against switch handle 5 but rather a sideways force which switch handle 5 will be found to be more resistant to by means of the pivoting mechanism normally found within wall switch handle 5 due to the standards imposed for safety reasons upon the construction of standard wall switches will enable switch handle 5 to resist this force and thus prevent damaging loads.

It is thus to be seen that the described invention covers not the specific decorative figure shown in FIG. 1 and described in this detailed description of the preferred embodiment but rather covers a wide range of decoratable figures which may be cut in plaque form and which when provided with the unique cam aperture 7 with respect to a pivot 10 adapted for installation using the existing upper screw 4 within a standard wall switch mount 2 will provide a usable and readily installable child operatable and damage resistant wall switching mechanism of particular use in children's rooms. Thus the invention disclosed and claimed within the instant application is limited not to the detailed description given but rather to the wide range of equivalents encompassed within the claims.

I claim:

1. An apparatus for operating a wall mounted electrical switch having a wall mount plate with upper and lower points of attachment to the switch and a switch handle movable from a first switching position to a second switching position, comprising:

a. a plaque pivotally mounted about the upper point of attachment of the wall mount plate to the switch, the plaque being provided with an elongated slanted slot having upper and lower portions, wherein the distance between the pivot point and upper slot portion is less than the distance between the pivot point and the lower slot portion;

b. a first pull cord means for pivoting said plaque from said first to said second switching position; and c. a second pull cord means for pivoting said plaque from said second to said first switching position.

2. The apparatus as described in claim 1 above, wherein said elongated slanted slot is formed by:

a. a first substantially straight side, adapted to contact a side of said switch handle in said first switch position;

b. a lower curved side, adapted to contactingly engage said switch handle from underneath;

c. a second, substantially straight side made opposite said first side of the aperture;

d. an upper curved side adapted to contactingly engage said switch handle about its top surface.

* * * * *